US006283389B1

(12) United States Patent
Hofmann

(10) Patent No.: US 6,283,389 B1
(45) Date of Patent: Sep. 4, 2001

(54) FUEL INJECTION VALVE FOR INTERNAL COMBUSTION ENGINES

(75) Inventor: Karl Hofmann, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/554,923

(22) PCT Filed: Jun. 11, 1999

(86) PCT No.: PCT/DE99/01705

§ 371 Date: Jul. 7, 2000

§ 102(e) Date: Jul. 7, 2000

(87) PCT Pub. No.: WO00/17512

PCT Pub. Date: Mar. 30, 2000

(30) Foreign Application Priority Data

Sep. 22, 1998 (DE) ..... 198 43 344

(51) Int. Cl.[7] ..... F02M 61/10

(52) U.S. Cl. ..... 239/533.11; 239/533.2; 239/533.3; 239/584

(58) Field of Search ..... 239/86, 533.2, 239/533.8, 533.9, 533.11, 584, 533.3, 88; 251/355; 285/328

(56) References Cited

U.S. PATENT DOCUMENTS

| | | | | |
|---|---|---|---|---|
| 1,737,985 | * | 12/1929 | Tursky | 239/533.11 X |
| 1,964,218 | * | 6/1934 | Schargorodsky | 239/86 X |
| 1,990,875 | * | 2/1935 | Mock | 239/584 X |
| 3,398,936 | * | 8/1968 | Deland | 239/86 X |
| 3,425,635 | * | 2/1969 | Guertler | 239/533.11 X |
| 3,581,728 | * | 6/1971 | Abraham | 251/355 X |

* cited by examiner

*Primary Examiner*—David A. Scherbel
*Assistant Examiner*—Steven J. Ganey
(74) *Attorney, Agent, or Firm*—Ronald E. Greigg; Edwin E. Greigg

(57) ABSTRACT

A fuel injection valve for internal combustion engines having a valve member axially displaceably guided in a bore of a valve body, the end of which valve member toward the combustion chamber has a valve sealing face that to control the passage of fuel to an injection opening discharging into the combustion chamber of the engine cooperates with a valve seat provided on the end of the bore toward the combustion chamber, and having a guide face on the end of the valve member remote from the combustion chamber, which guide face guides the valve member slidably displaceably in the bore. In the guide face of the valve member, many recesses are provided, which center the valve member hydraulically in the bore.

9 Claims, 2 Drawing Sheets

FUEL INJECTION VALVE FOR INTERNAL COMBUSTION ENGINES

BACKGROUND OF THE INVENTION

1. Field of the Invention

The invention relates to a fuel injection improved fuel injection valve for internal combustion engines.

2. Description of the Prior Art

In a fuel injection valves of this type, a piston-shaped valve member is guided so that it can move axially in a bore of a valve body, wherein the end of the valve member oriented toward the combustion chamber has a valve sealing face, which it uses to cooperate with a stationary valve seat provided on the end of the bore oriented toward the combustion chamber in order to control the through flow of fuel to an injection opening that feeds into the combustion chamber of the internal combustion engine. The opening stroke motion of the valve member occurs in opposition to a restoring force, usually the force of a valve spring, by means of a high injection pressure of the incoming fuel that acts on the valve member in the opening direction.

In order to introduce the force of this opening pressure onto the valve member, the valve member has a pressure shoulder that is constituted by an annular step, which protrudes into a pressure chamber formed by means of a cross sectional widening of the bore. With its cross sectionally enlarged shaft part remote from the combustion chamber, the valve member is guided so that it can slide in a sealed fashion in a part of the bore in the valve body which acts as a guide section. This guide section of the valve member thus constitutes a guide surface at the end of the valve member remote from the combustion chamber, which is subjected to a high degree of wear due to its very snug guidance in the bore. Therefore the known fuel injection valves, particularly at very high injection pressures, have the disadvantage that fuel pressure fields build up inside the valve member guide, which transmit one-sided lateral forces onto the valve member and thus, through a one-sided contact of the valve member, cause a one-sided surface pressure between the valve member and the bore guide surface, which leads to a more intense wear that can result in undesired leakage and the destruction of the injection valve.

The German utility model DE 295 04 608 discloses a fuel injection valve for internal combustion engines in which the guide surface between the valve member and the guide bore in the valve body is divided into two separate guide regions. This should prevent a one-sided contact of the valve member against the wall of the guide bore and consequently a one-sided wear. However, the known fuel injection valve has the disadvantage that as a result of the large clearance between the surfaces of the valve member and the guide bore wall between the separate guide regions, a tearing of a lubrication film between the moving components can occur, which once more encourages wear.

SUMMARY OF THE INVENTION

The fuel injection valve for internal combustion engines according to the present invention, has the advantage over the prior art that a tilting of the valve member and consequently a one-sided wear on the guide surfaces can be reliably prevented. This is achieved in an advantageous manner through the provision of one more recesses producing a hydraulic wedge between the valve member and the guide bore in the valve body, and this hydraulic wedge extends over the essential part of the guide surface between the valve member and the bore and therefore hydraulically centers the valve member in the bore. These recesses in the guide surface of the valve member are preferably disposed in substantially even distribution over its circumference so that a uniform pressure compensation on the valve member is produced, which prevents local pressure peaks between the valve member and the guide bore and therefore reliably prevents the one-sided introduction of lateral forces.

These recesses in the guide surface of the valve member can be embodied as grooves, preferably lateral grooves, point indentations, or also as oblique grooves, wherein other forms of recesses are also alternatively possible here. In order to be able to reliably prevent a tearing of the hydraulic oil lubrication film between the moving valve member and the bore wall guiding it, the recesses are provided only in a micrometer range of approx. 1 mm maximally.

With the use of lubrication grooves extending lateral to the axis of the valve member, these are embodied as arched, with a radius, wherein this radius is preferably about 0.1 mm. The lateral grooves in this connection preferably should have a width of approx. 0.16 mm, a maximal depth of approx. 0.03 mm, and a spacing from one another of up to about 1 mm and preferably approx. 0.6 to 0.8 mm, with a valve member diameter of approx. 4 mm in the vicinity of the guide surface.

With the use of a multitude of individual recesses, which thus constitute so-called lubrication pockets, these preferably have a diameter between 0.2 and 0.5 mm and are incorporated into the valve member to a depth of approx. 0.02 to 0.05 mm. The production of these lubrication pockets preferably takes place by means of a laser burning process or by means of rolling them into the circumference surface of the valve member.

Another advantage can be achieved if the recesses in the guide surface of the valve member, which contribute to a hydraulic pressure compensation, are embodied as oblique grooves that encompass approx. 180° of the valve member circumference. These oblique grooves can be embodied in a particularly advantageous manner as helically curved, which has the advantage that with a one-sided contact of the valve member against the guide bore, the higher hydraulic pressure is introduced at the beginning of the helical groove and then conveyed to the contacting side of the valve member. In this connection, the width of the helical groove produces an intensified restoring force which encourages a centering of the valve member in the guide bore.

In the exemplary embodiments described, the hydraulic pressure compensation recesses are incorporated into the circumference surface of the valve member, however it is alternatively also possible to provide these pressure compensation recesses in the wall of the guide bore in the vicinity of the guide surface of the valve member and to produce the same hydraulic centering effective in this manner. Even in this case, the pressure compensation recesses should be disposed in the range of micrometer dimensions in order to reliably prevent a tearing of the lubrication film between the valve member and the bore.

BRIEF DESCRIPTION OF THE DRAWINGS

Other advantages and advantageous embodiments of the invention will be apparent from the detailed description contained herein below, taken in conjunction with the drawings, in which.

DESCRIPTION OF THE PREFERRED EMBODIMENTS

Figure 1:
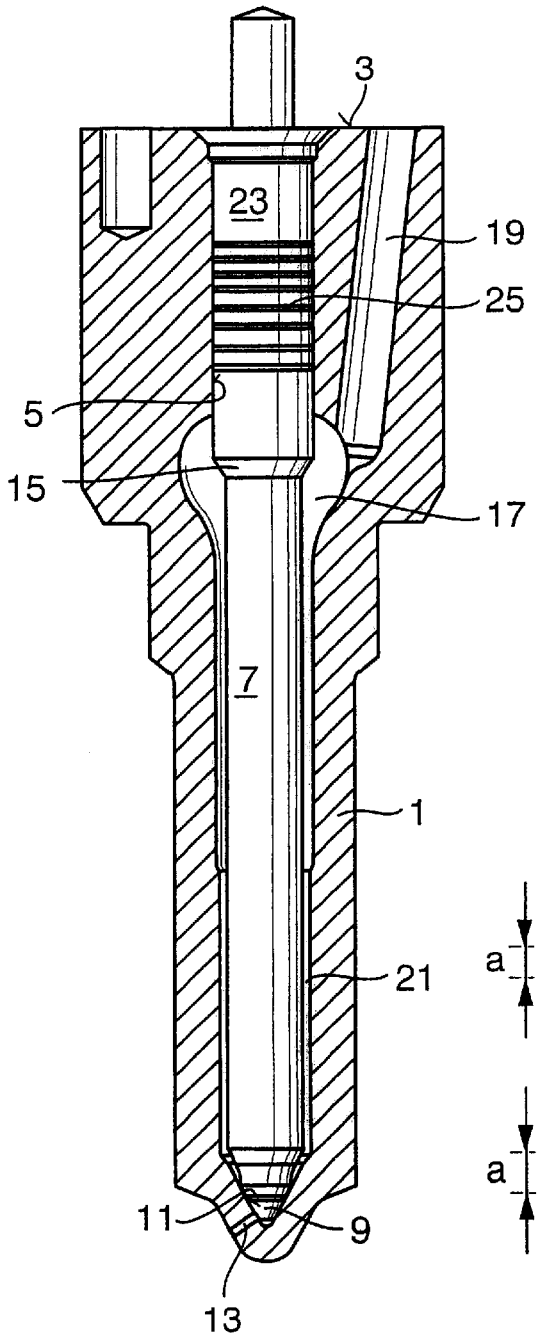
FIG. 1 is a longitudinal section through a first exemplary embodiment of the fuel injection valve according to the invention, in which the recesses in the guide surface of the valve member are embodied as lateral or annular grooves.

The first exemplary embodiment of the fuel injection valve for internal combustion engines according to the invention, of which only its region that is essential to the invention is shown in FIG. 1, has a valve body 1 which has an axial blind bore 5 formed therein, leading from its end face 3 remote from the combustion chamber. A piston-shaped valve member 7 is guided so that it can move axially in this blind bore 5 and its lower end oriented toward the combustion chamber is embodied as conical, wherein the conical surface constitutes a conical valve sealing face 9. This valve sealing face 9 cooperates with a conical valve seat 11, which defines the blind bore 5 on the combustion chamber end, and an injection opening 13 leads from this valve seat, downstream of the sealing line between the valve sealing face 9 and valve seat 11, and feeds into the combustion chamber of the engine to be fed. In addition, the valve member 7 has a pressure shoulder 15 which is formed by a diametrical reduction of the valve member 7, points in the direction of the valve sealing face 9, and protrudes into a cross sectional widening of the bore 5 in the valve body 1, which widening constitutes a pressure chamber 17. This pressure chamber 17 is fed by a high-pressure conduit 19 leading obliquely from the end face 3 and this high-pressure conduit is connected in a manner not shown in detail by way of supply lines to a fuel injection pump that intermittently fills the pressure chamber 17 with high pressure fuel. On the downstream end, the pressure chamber 17 continues by way of an annular gap 21 formed between the valve member 7 and the bore wall 5 to the valve sealing face 11 so that the high fuel pressure prevails at the sealing cross section between the valve sealing face 9 and the valve seat 11.

With its valve member shaft region that adjoins the pressure shoulder 15 on its end remote from the valve seat, the valve member 7 constitutes a guide surface 23 with which the valve member 7 is guided so that it can slide against the wall of the blind bore 5 with a very snug fit. Annular grooves 25 which extend lateral to the axis of the valve member 7 in the first exemplary embodiment are incorporated into this guide surface 23, as is also depicted on an enlarged scale in FIGS. 2 and 2A. By means of a hydraulic pressure compensation cushion, these micro-annular grooves thus reliably prevent a tilting or jamming of the valve member 7 in the blind bore 5 and consequently prevent a one-sided wear of the guide surfaces. The annular grooves 25 in the wall of the guide surface 23 are embodied as small so that a tearing of the lubrication film between the guide surface 23 and the wall of the bore 5 can be reliably prevented. With a valve member diameter of 4 mm in the vicinity of the guide surface 23, the annular grooves 25 in the exemplary embodiment have a width b of approx. 0.16 mm, and a depth t of approx. 0.03 mm. The distances a between the individual annular grooves 25 preferably are =1.0 mm and may vary from about 0.6 mm on the end of the guide surface 23 remote from the valve seat and vary by 0.8 mm on the end oriented toward the valve seat. Furthermore, the annular grooves 25 in the first exemplary embodiment have a radius-shaped cross sectional surface, wherein the radius of the annular grooves 25 is 0.1 mm in the exemplary embodiment.

Figure 2:
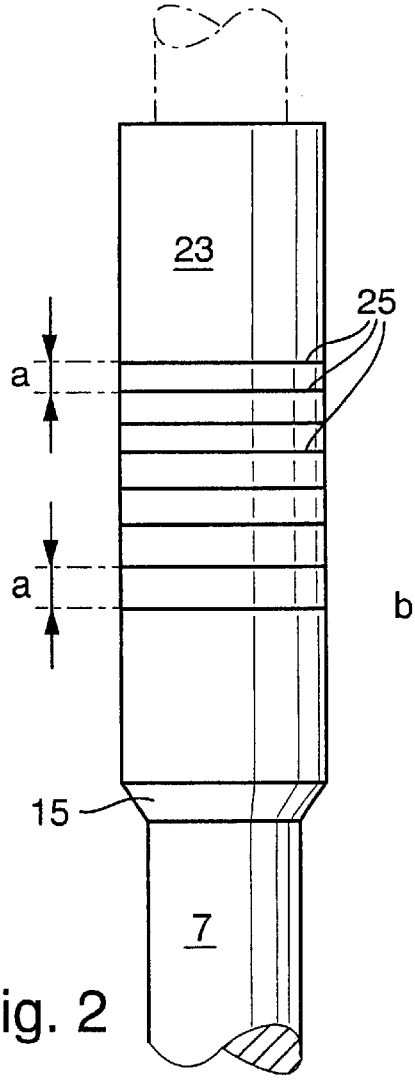
FIGS. 2 and 2*a* show enlarged details from FIG. 1 in the vicinity of the guide surface of the valve member.
Figure 2A:
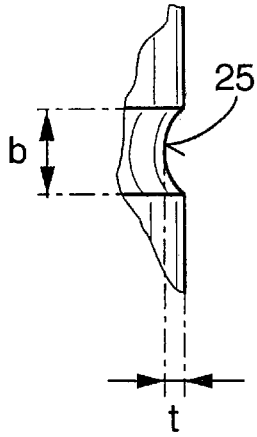
Figure 3:
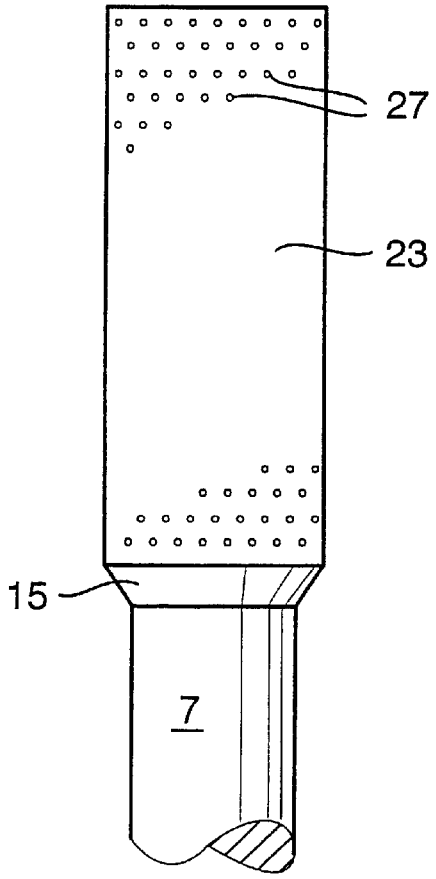
FIG. 3 shows a second exemplary embodiment in a simplified depiction of the valve member in the vicinity of the guide surface, in which the recesses are embodied as lubrication pockets or indentations.

The second exemplary embodiment, which is only shown in the vicinity of the guide surface 23 of the valve member 7 in FIG. 3, differs from the first exemplary embodiment shown in FIGS. 1 to 2A only in the type of recesses in the guide surface 23 which constitute the pressure compensation recesses. In the second exemplary embodiment, these recesses in the guide surface 23 of the valve member 7 are embodied as a multitude of lubrication pockets 27 which are disposed distributed over the circumference of the guide surface 23. The lubrication pockets are embodied as recesses in the guide surface 23 and have a diameter between 0.2 and 0.5 mm, which are incorporated into the wall of the valve member 7 to a depth of approx. 0.02 to 0.05 mm. These lubrication pocket recesses are preferably let into the guide surface 23 by means of a laser burning process or by means of being rolled into this guide surface 23.

Figure 4:
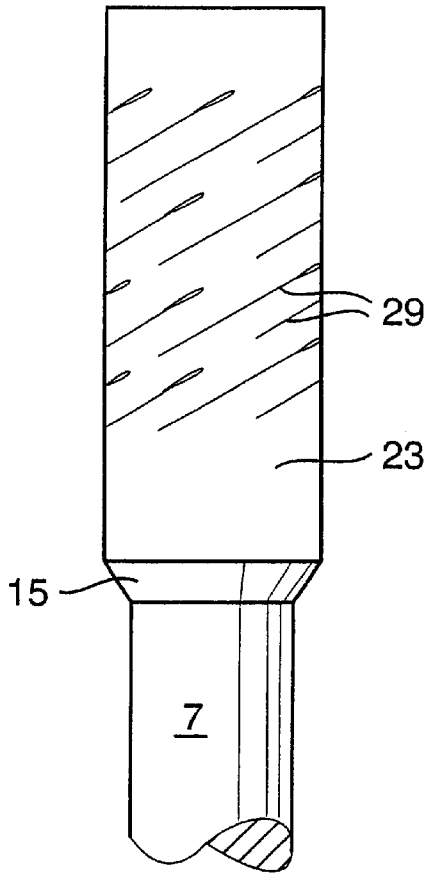
FIG. 4 shows a third exemplary embodiment according to the depiction in FIG. 3, in which the recesses are embodied as oblique grooves in the guide surface of the valve member.

In the third exemplary embodiment of the fuel injection valve according to the invention shown in FIG. 4, the pressure compensation recesses in the guide surface 23 of the valve member 7 are embodied as oblique grooves 29, which each encompass approx. 180° of the valve member circumference and are disposed offset from one another. These oblique grooves 29 have a greater cross section at their one end than at the second remote end, or alternatively, are embodied as helical grooves in a manner that is not shown in detail. The oblique grooves 29 widen in the direction of the upper end remote from the combustion chamber, from approx. 0.15 mm at the lower end to approx. 0.3 to 0.5 mm at the upper end.

The offset disposition of the cross-sectionally enlarged end regions of the individual oblique grooves results in the fact that in the event of a one-sided contact of the valve member 7 against the wall of the blind bore 5, the higher hydraulic pressure at the beginning of the oblique groove, in this instance remote from the contacting end, is conveyed to the contacting end of the valve member and an increased hydraulic pressure builds up there which moves the valve member 7 back into its centered position in the blind bore 5.

The fuel injection valve for internal combustion engines according to the invention functions in the following manner.

During the injection pauses, the valve member 7 is held with its valve sealing face 9 in sealed contact against the valve seat 11 by means of a valve spring that is not shown in detail so that the fuel passage from the pressure chamber 17 to the injection opening 13 is closed. If a fuel injection is to occur at the injection valve, high-pressure fuel is supplied by the fuel injection pump, not shown, by way of the high-pressure conduit 19 into the pressure chamber 17 where it engages the valve member 7 in the opening direction by way of the pressure shoulder 15. After the necessary injection opening pressure is achieved, this hydraulic opening pressure acting on the pressure shoulder 15 exceeds the restoring force of the valve spring and the valve member 7 is lifted from its valve seat 11 counter to the closing force of the valve spring. High-pressure fuel then flows out of the pressure chamber 17 by way of the annular gap 21 and the now-opened cross section between the valve sealing face 9 and the valve seat 11 to the injection opening 13 and via this opening, reaches injection into the combustion chamber of the internal combustion engine to be fed. The injection is stopped by virtue of the fact that the high-pressure fuel delivery into the pressure chamber 17 is stopped so that the high fuel pressure drops back below the closing pressure of the valve spring and the valve spring slides the valve member 7 back into contact with the valve seat 11. The valve sealing face 9 seals the through flow cross section to the injection opening 13 again at the valve seat 11 so that no further fuel is injected into the combustion chamber of internal combustion engine.

In order to be able to reliably prevent a one-sided tilting of the valve member 7 in the blind bore 5 and attendant wear on the guide surfaces, corresponding pressure compensation recesses are incorporated into the guide surface 23 of the valve member 7, which in the exemplary embodiments described above are embodied as grooves or recesses. These pressure compensation grooves 25, 29 or lubrication pockets 27 are filled with fuel and thereby constitute a hydraulic pressure cushion between the valve member 7 and the wall of the blind bore 5 by means of which the valve member 7 is centered in the blind bore 5. In order to simultaneously be able to prevent a tearing of the lubrication film that is disposed between the valve member 7 and the blind bore wall 5 and is necessary for a uniform lubrication, the pressure compensation recesses in the wall of the guide surface 23 of the valve member 7 are embodied in the micrometer range so that with a simultaneous hydraulic stabilization, a tearing of the lubrication film can be reliably prevented.

In this manner, with the fuel injection valve according to the invention, it is possible to prevent a one-sided contact of the valve member 7 against the wall of the bore 5 and thus to reliably prevent a wear that would lead to a malfunctioning of the fuel injection valve.

The foregoing relates to a preferred exemplary embodiments of the invention, it being understood that other variants and embodiments thereof are possible within the spirit and scope of the invention, the latter being defined by the appended claims.

What is claimed is:

1. In a fuel injection valve for internal combustion engines having a valve member (7) that is guided so that the valve member moves axially in a bore (5) of a valve body (1), wherein the end of the valve member oriented toward a combustion chamber has a valve sealing face (9) which cooperates with a valve seat (11) provided on an end of the bore (5) oriented toward the combustion chamber in order to control a through flow of fuel to at least one injection opening (13) and into the combustion chamber of the engine and having a guide surface (23) at an end of the valve member (7) remote from the combustion chamber, the guide surface guides the valve member (7) so that the valve member moves in a sliding fashion in the bore (5), the improvement comprising a plurality of recesses provided in the guide surface (23) of the valve member (7), in which the recesses are embodied as axially spaced grooves (25) that extend lateral to the axis of the valve member (7) to hydraulically center the valve member (7) in the bore (5), and the grooves (25) have a radius-shaped cross section.

2. The fuel injection valve according to claim 1, wherein the grooves (25) are embodied so that the grooves are axially space from one another by up to about 1.0 mm and have a width of about 0.16 mm, a maximal depth of about 0.03 mm, and a spacing from one another of approx. 0.6 to 0.8 mm.

3. The fuel injection valve according to claim 1, wherein the radius of the groove 25 is about 0.1 mm.

4. In a fuel injection valve internal combustion engines having a valve member (7) that is guided so that the valve member moves axially in a bore (5) of a valve body (1), wherein the end of the valve member oriented toward a combustion chamber in order to control a through of fuel to at least one injection opening (13) and into the combustion chamber of the engine and having a guide surface (23) at an end of the valve member (7) remote from the combustion chamber, the guide surface guides the valve member (7) so that the valve member moves in a sliding fashion in the bore (5), the improvement comprising a plurality of recesses provided in the guide surface (23) of the valve member (7), in which the recesses hydraulically center the valve member (7) in the bore (5), and the recesses in the guide surface (23) of the valve member (7) are emdodied as a plurality of spaced lubrication pockets (27), in which the pockets are distributed over the circumfrence of the guide surface (23) along at least a position of a length of the guide surface.

5. The fuel injection valve according to claim 1, wherein the lubrication pockets (27) in the guide surface (23) have a diameter between 0.2 and 0.5 mm and are let into the guide surface (23) to a depth of approx. 0.02 to 0.05 mm.

6. The fuel injection valve according to claim 4, wherein the lubrication pockets (27) are recesses produced by means of a laser process.

7. The fuel injection valve according to claim 4, wherein the lubrication pockets (27) are rolled into the circumfrence surface of the valve number(7).

8. In a fuel injection valve for internal combustion engines having a valve member (7) that is guided so that the valve member moves axially in a bore (5) of a valve body (1), wherein the end of the valve member oriented toward a combustion chamber has a valve sealing face (9) which cooperates with a valve seat (11) provided on an end of the bore (5) oriented toward the combustion chamber in order to control a through flow of fuel to at least one injection opening (13) and into the combustion chamber of the engine and a guide surface (23) at an end of the valve member (7) remote from the combustion chamber, the guide surface guides the valve member (7) so that the valve moves in a sliding fashion in the bore (5), the improvement comprising a plurality of recesses provided in the guide surface (23) of the valve member (7), in which the recesses hydraulically center the valve member (7) in the bore (5), the recesses in the guide surface (23) of the valve member (7) are embodied as oblique grooves (29) that encompass 180° of the valve member circumfrence, and the oblique grooves (29) widen out in a direction of an end of the valve member remote from the valve seat.

9. The fuel injection valve according to claim 8, wherein the oblique grooves (29) are embodied as helically curved grooves.

* * * * *